US006422496B1

(12) United States Patent
Doelle

(10) Patent No.: US 6,422,496 B1
(45) Date of Patent: Jul. 23, 2002

(54) REFINER FOR REFINING A FIBER SUSPENSION

(75) Inventor: Klaus Doelle, Menasha, WI (US)

(73) Assignee: Voith Sulzer Paper Technology North America, Inc., Appleton, WI (US)

( * ) Notice: Subject to any disclaimer, the term of this patent is extended or adjusted under 35 U.S.C. 154(b) by 3 days.

(21) Appl. No.: 09/593,886

(22) Filed: Jun. 14, 2000

(51) Int. Cl.[7] ..... B02C 13/20

(52) U.S. Cl. ..... 241/261.2; 241/261.3; 241/296; 241/297

(58) Field of Search ..... 241/261.2, 261.3, 241/296, 297, 298

(56) References Cited

U.S. PATENT DOCUMENTS

| | | | | | |
|---|---|---|---|---|---|
| 4,269,362 | A | | 5/1981 | Berggren | 241/28 |
| 4,813,621 | A | * | 3/1989 | Kleinhans | 241/261.2 |
| 5,042,726 | A | * | 8/1991 | Reinhall | 241/261.3 |
| 5,683,048 | A | | 11/1997 | Virving | 241/261.2 |
| 5,695,136 | A | | 12/1997 | Rohden et al. | 241/261.3 |
| 5,704,559 | A | * | 1/1998 | Froberg et al. | 241/261.3 |
| 5,730,376 | A | * | 3/1998 | Schneid et al. | 241/261.2 |
| 5,890,665 | A | * | 4/1999 | Arasmith et al. | 241/261.2 |
| 5,904,308 | A | * | 5/1999 | Schnell | 241/261.3 |
| 5,975,438 | A | | 11/1999 | Garasimowicz | 241/15 |

* cited by examiner

*Primary Examiner*—Ed Tolan
(74) *Attorney, Agent, or Firm*—Taylor & Aust, P.C.

(57) ABSTRACT

A refiner for refining a fiber suspension includes a first disk which is rotatable or stationary, and a second disk which is rotatable. A first tackle is coupled with a first disk or the second disk. A second tackle is coupled with the other of the first disk or second disk. The second tackle includes a plurality of generally annular rows of teeth with a radially inner row and a radially outer row. Adjacent teeth within a same row are separated by a groove therebetween. Adjacent rows are concentrically spaced by a generally annular gap therebetween. The concentrically spaced rows are divided into a plurality of adjacent sectors, with each sector having opposing side edges extending through and between the radially inner row and the radially outer row to define a substantially unimpeded flow-through channel for the fiber suspension.

16 Claims, 3 Drawing Sheets

REFINER FOR REFINING A FIBER SUSPENSION

BACKGROUND OF THE INVENTION

1. Field of the Invention

The present invention relates to refiners for refining a fiber suspension, and, more particularly, to a tackle which is coupled with a disk within the refiner.

2. Description of the Related Art

A paper-making machine receives a fiber suspension which is prepared from a source of fiber, such as wood, and manufactures a fiber web, such as a paper web. The fiber source within the fiber suspension must be broken down into individual fibers which are maintained in a deflocculated state within the fiber suspension.

Disk refiners are used to separate the individual fibers within the fiber suspension and/or to clean foreign matter such as dirt, etc. from the fiber suspension. A disk refiner typically includes a pair of opposing disks, with one or both of the disks being rotatable relative to each other. Each disk carries a plate, also known as a "tackle", having a plurality of teeth mounted thereon. The shape of the teeth, as well as the angular orientation of the teeth define the particular processing action which the tackle effects on the fibers within fiber suspension. For example, the teeth may be configured and positioned on the tackle to provide a cutting action or a brushing action to the fibers within the fiber suspension.

Typically, the teeth are arranged at different oblique angles relative to each other such that the fiber suspension changes flow directions as it flows from the inside diameter to the outside diameter of the tackle in the grooves between adjacent teeth. Although the changing flow directions result in effective refining of the fiber suspension, the changing flow directions also in essence cause a resistance to the flow through the tackle which in turn raises the input energy requirements for operation of the refiner.

What is needed in the art is a refiner for a fiber suspension which provides a higher throughput rate with lower energy requirements. What is further needed in the art is a refiner which provides effective but yet gentle refining of the fiber suspension.

SUMMARY OF THE INVENTION

The present invention provides a refiner for refining a fiber suspension with a tackle having concentric rows of teeth which are subdivided into quadrants, and further subdivided into sectors within each quadrant, such that the sectors define substantially unimpeded flow-through channels allowing the fiber suspension to flow from the inside diameter to the outside diameter of the tackle.

The invention comprises, in one form thereof, a refiner for refining a fiber suspension, including a first disk which is rotatable or stationary, and a second disk which is rotatable. A first tackle is coupled with a first disk or the second disk. A second tackle is coupled with the other of the first disk or second disk. The second tackle includes a plurality of generally annular rows of teeth with a radially inner row and a radially outer row. Adjacent teeth within a same row are separated by a groove therebetween. Adjacent rows are concentrically spaced by a generally annular gap therebetween. The concentrically spaced rows are divided into a plurality of adjacent sectors, with each sector having opposing side edges extending through and between the radially inner row and the radially outer row to define a substantially unimpeded flow-through channel for the fiber suspension.

An advantage of the present invention is that the unimpeded flow-through channels allow the refiner to be operated with lower energy input requirements.

Another advantage is that the throughput rate of the fiber suspension through the refiner is increased.

Yet another advantage is that the teeth may be configured with a desired cross sectional shape to perform various refining functions on the fiber suspension, while at the same time still maintaining a higher throughput rate and lower input energy requirement.

A further advantage is that a relatively gentle refining action is carried out on the fiber suspension within the refiner.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
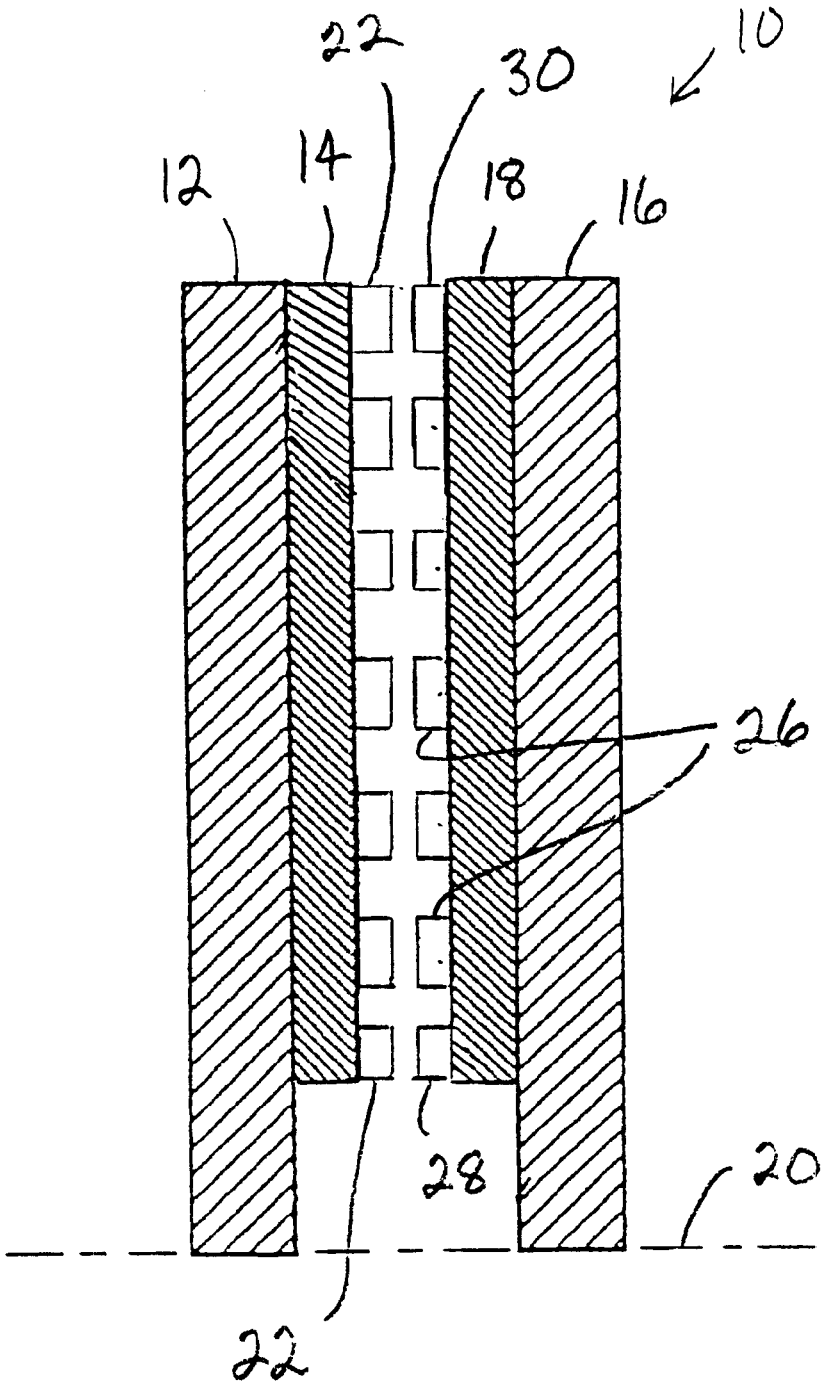
FIG. 1 is a simplified, fragmentary, sectional view of an embodiment of a refiner of the present invention.

Referring now to the drawings, and more particularly to FIG. 1, there is shown a schematic, fragmentary, sectional view of a refiner 10 of the present invention for refining a fiber suspension. The term "refiner", as used herein, is intended to mean an apparatus which includes a pair of rotating disks which carry one or more respective tackles each, such as a refiner, disperger, etc. Refiner 10 shown in FIG. 1 includes a first disk 12 carrying a first tackle 14, and a second disk 16 carrying a second tackle 18. For simplicity of illustration, disks 12, 16 and tackles 14, 18 are shown in simplified form in FIG. 1. Moreover, only half of each disk 12, 16 is shown, which rotate in a direction perpendicular to the drawing of FIG. 1 about axis of rotation 20

First disk 12 may either be rotatable or stationary within refiner 10. In the embodiment shown, first disk 12 is assumed to be stationary and thus a stator. First tackle 14 is coupled with first disk 12 in a suitable manner, such as by using fasteners (not shown). First tackle 14 includes a plurality of concentrically positioned, annular rows of teeth 22 which may have a suitable shape, depending upon the particular application of refiner 10.

Second disk 16 is rotatable about axis of rotation 20 and thus is a rotor. Second tackle 18 is coupled with second disk 16 in a suitable manner, such as by using fasteners, etc. For example, referring more particularly to FIGS. 2 and 3, second tackle 18 may be coupled with second disk 16 using a plurality of fasteners such as bolts which pass through openings 24. Second tackle 18 is thus removably attached to second disk 16 for easy repair and replacement.

Second tackle 18 includes a plurality of generally annular rows of teeth 26, including a radially inner row 28 and a radially outer row 30. Adjacent teeth 26 within a same row are separated by a groove 32 therebetween. Grooves 32 allow the fiber suspension to flow in a radially outward direction through second tackle 18 as a result of centrifugal force during rotation of second disk 16. The width of grooves 32 between adjacent teeth 26 may vary from one row to another. In general, the width of each groove 32 decreases in a radially outward direction from one row to another so that the fibers within the fiber suspension may be further refined as the fiber suspension flows in a radially outward direction past second tackle 18.

Adjacent rows of teeth 26 are concentrically spaced relative to each other by a generally annular gap 34 therebetween. As the fiber suspension flows through grooves 32 and into each gap 34, the pressure rises and falls to cause pressure fluctuations within the fiber suspension which aid in the refining process.

Figure 2:
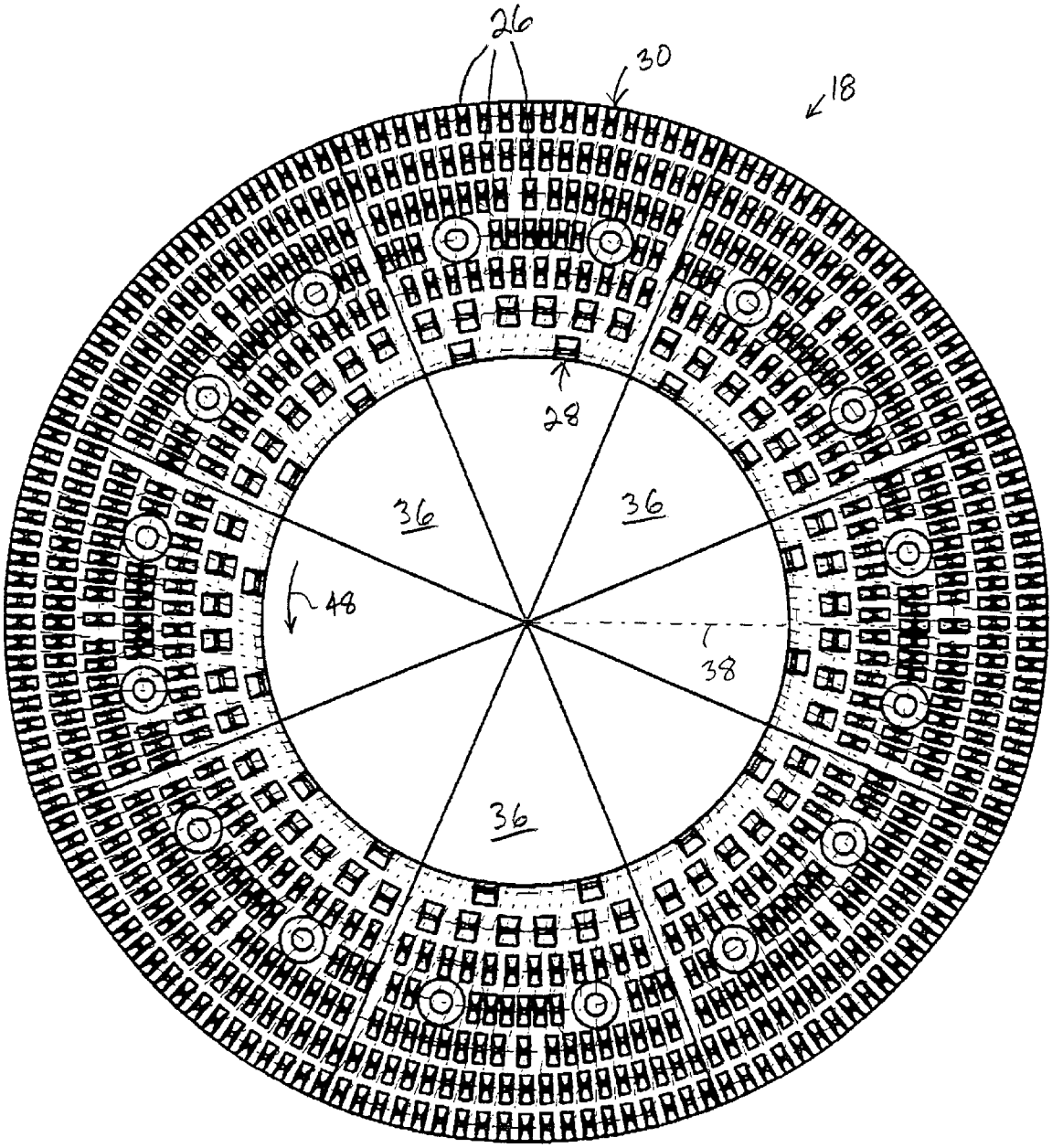
FIG. 2 is a plan view of a tackle of the present invention shown in FIG. 1.
Figure 3:
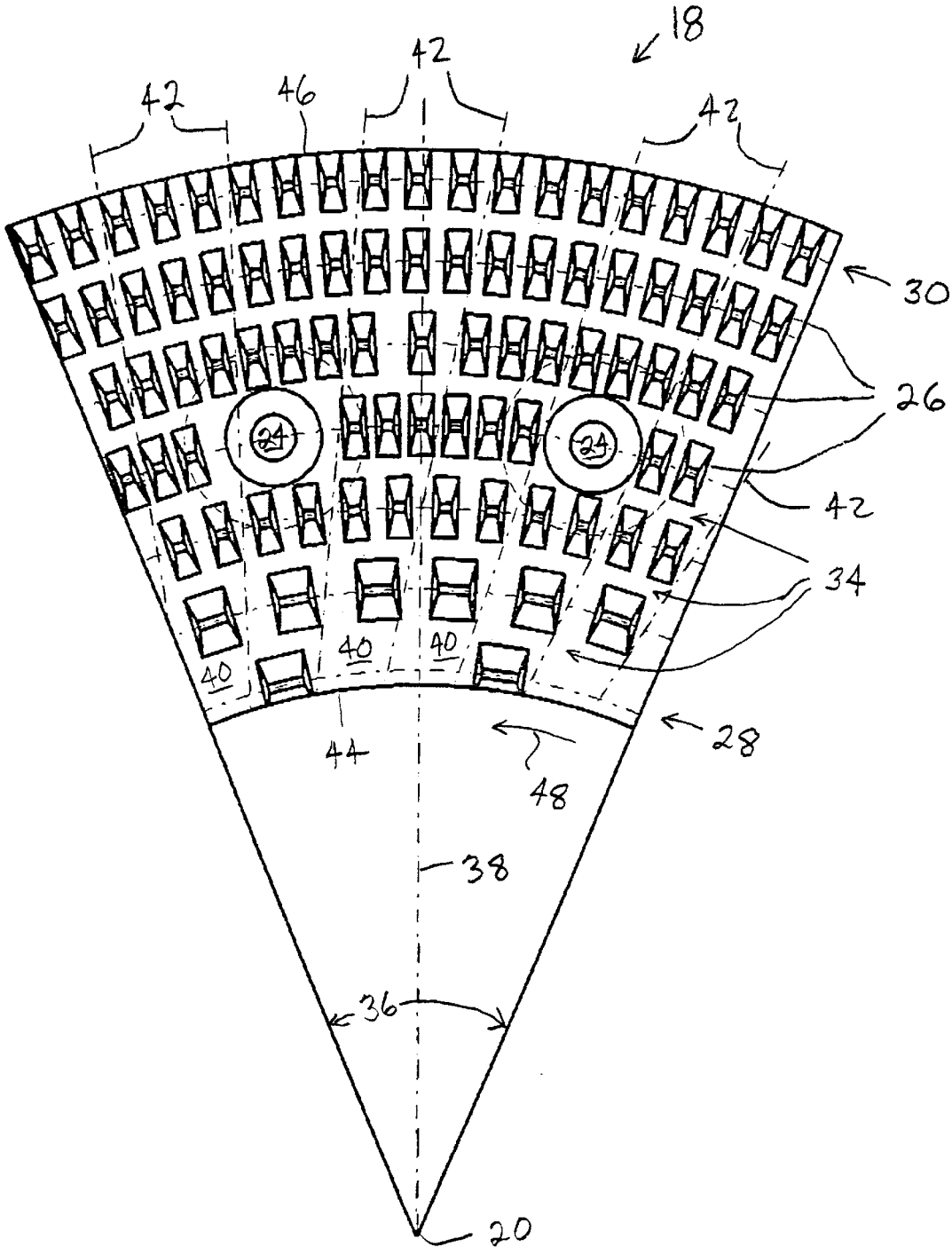
FIG. 3 is an enlarged, partial view of the tackle shown in FIGS. 1 and 2.

According to an aspect of the present invention, second tackle 18 is configured such that teeth 18 are positioned in a repeating pattern within the plurality of rows providing multiple flow-through channels for the fiber suspension through and between radially inner row 28 and radially outer row 30 (i.e., from the inside diameter to the outside diameter of second tackle 18 in the embodiment shown). As shown in FIGS. 2 and 3, second tackle 18 is divided into a plurality of quadrants 36, which may be further divided by a bisector 38 (FIG. 3). Within each quadrant 36, the concentrically spaced rows of teeth 26 are divided into a plurality of adjacent sectors 40. Each sector 40 includes opposing side edges 42 which extend from the inside diameter 44 to the outside diameter 46 of second tackle 18. Teeth 26 are positioned on second tackle 18 so as not to substantially overlie side edges 42 of sectors 40, thereby providing the substantially unimpeded flow-through channel for the fiber suspension.

It may be observed from FIG. 3 that sectors 40 are configured substantially identical to each other. Side edges 42 are non-parallel and diverging from each other from radially inner row 28 to radially outer row 30. Each side edge 42 is positioned at a predetermined angular orientation relative to axis of rotation 20 of second disk 16 and second tackle 18. The number of sectors 40, and thus the number of side edges 42 within each quadrant 36, as well as the particular angular orientation of side edges 42, may vary from one application to another. In the embodiment shown, second tackle 18 includes eight quadrants 36, with each quadrant 36 having at least five sectors 40. Sectors 40 repeat around the periphery of second tackle 18, and thus repeat from one quadrant 36 to another. In the embodiment shown, second tackle 18 is assumed to rotate in the direction of arrow 48, and side edges 42 are disposed with a trailing orientation with respect to direction of rotation 48. Depending upon the particular application, the angular orientation of side edges 42 may vary with respect to direction of rotation 48. For example, side edges 42 may be generally perpendicular or may be oriented in a forward facing or reverse angular orientation with respect to direction of rotation 48. The particular angular orientation effects the flow-through rate of the fiber suspension past second tackle 18.

In the embodiment of the invention described above and shown in FIGS. 1–3, tackle 18 is configured such that each sector 40 includes multiple rows, with a number of the rows having a plurality of teeth 26 within the same sector. However, it is also to be understood that tackle 18 may be configured such that each row has a different number of teeth (e.g., a single tooth) within each sector. Other configurations are also possible.

Teeth 26 may be configured with a desired cross sectional shape, depending upon the particular application with which second tackle 18 is utilized. In the embodiment shown, teeth 26 have a truncated cross section, but may also be configured with a triangular, square, rectangular or other suitable cross section. The particular cross sectional shape of teeth 26 may be selected to provide desired functionality, such as cutting, brushing, etc.

During use, fiber suspension is fed into the space between first disk 12 and second disk 16 near axis of rotation 20. Second disk 16 rotates at a particular operating speed, while first disk 12 is maintained stationary. The centrifugal force caused by rotation of second disk 16 causes the fluid to move in a radially outward direction between first tackle 14 and second tackle 16. The fiber suspension flows through grooves 32 between adjacent teeth, and gaps 34 between adjacent rows of teeth. The mechanical forces imparted to the fiber suspension by teeth 26 as well as the pressure fluctuations during constriction and expansion of the flow refine the fiber suspension. In addition to flowing through grooves 32 and gaps 34, the fiber suspension is also allowed to flow in a substantially unimpeded manner through the flow-through channels coinciding with side edges 42 which extend from inside diameter 44 to outside diameter 46.

In the embodiment shown, second tackle 18 is configured with quadrants 36 and sectors 40, as described above, to define the substantially unimpeded flow-through channels for the fiber suspension. However, it is to be understood that first tackle 14 and/or second tackle 18 may be configured with a tackle to define the substantially unimpeded flow-channels as described above.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A refiner for refining a fiber suspension, comprising:

a first disk which is one of rotatable and stationary;

a second disk which is rotatable;

a first tackle coupled with one of said first disk and said second disk;

a second tackle coupled with another of said first disk and said second disk, said first disk being mounted relative to said second disk such said first tackle is positioned adjacent said second-tackle, said second tackle including a plurality of adjacent sets of generally annular rows of second-tackle teeth with a radially inner row and a radially outer row, adjacent said second-tackle teeth within a same row being separated by a groove therebetween, adjacent said rows of said second-tackle teeth being concentrically spaced by a generally annular gap therebetween, said concentrically spaced rows being divided into a plurality of adjacent sectors, each sector having opposing side edges extending through and between said radially inner row and said radially outer row to define a substantially unimpeded flow-through channel for the fiber suspension.

2. The refiner of claim 1, each of said sectors being substantially the same.

3. The refiner of claim 2, said side edges of said sectors being non-parallel and diverging from each other from said radially inner row to said radially outer row.

4. The refiner of claim 1, said second tackle being further divided into a plurality of quadrants, said sectors repeating from one quadrant to another.

5. The refiner of claim 4, said second tackle including eight quadrants and at least five sectors per quadrant.

6. The refiner of claim 1, said second tackle having an axis of rotation, said side edges of each said sector being at a predetermined angular orientation with respect to said axis of rotation.

7. The refiner of claim 1, said first refiner disk being stationary, said first tackle and said second tackle being configured substantially the same.

8. The refiner of claim 1, said second-tackle teeth having one of a triangular, square, rectangular and truncated cross section.

9. A refiner for refining a fiber suspension, comprising:

a first disk which is one of rotatable and stationary;

a second disk which is rotatable;

a first tackle coupled with one of said first disk and said second disk;

a second tackle coupled with another of said first disk and said second disk, said first disk being mounted relative to said second disk such that said first tackle is positioned adjacent said second tackle, said second tackle including a plurality of adjacent sets of generally annular rows of second-tackle teeth with a radially inner row and a radially outer row, adjacent said second-tackle teeth within a same row being separated by a groove therebetween, adjacent said rows of said second-tackle teeth being concentrically spaced by a generally annular gap therebetween, said concentrically spaced rows being divided into a plurality of adjacent sectors, each said sector having opposing side edges, said second-tackle teeth within said rows of each said sector being positioned such that said opposing side edges extend through and between said radially inner row and said radially outer row to define a substantially unimpeded flow-through channel for the fiber suspension.

10. The refiner of claim 9, each of said sectors being substantially the same.

11. The refiner of claim 10, said side edges of said sectors being non-parallel and diverging from each other from said radially inner row to said radially outer row.

12. The refiner of claim 9, said second tackle being further divided into a plurality of quadrants, said sectors repeating from one quadrant to another.

13. The refiner of claim 12, said second tackle including eight quadrants and at least five sectors per quadrant.

14. The refiner of claim 9, said second tackle having an axis of rotation, said side edges of each said sector being at a predetermined angular orientation with respect to said axis of rotation.

15. The refiner of claim 9, said first refiner disk being stationary, said first tackle and said second tackle being configured substantially the same.

16. The refiner of claim 9, said second-tackle teeth having one of a triangular, square, rectangular and truncated cross section.

* * * * *